US007534389B2

(12) United States Patent
Luo

(10) Patent No.: US 7,534,389 B2
(45) Date of Patent: May 19, 2009

(54) APPARATUS AND PROCESS FOR EXTRACTING ARSENIC IN VACUUM

(75) Inventor: Wenzhou Luo, Kunming Province (CN)

(73) Assignee: Beijing Goldtech Co., Ltd., Beijing (CN)

( * ) Notice: Subject to any disclaimer, the term of this patent is extended or adjusted under 35 U.S.C. 154(b) by 729 days.

(21) Appl. No.: 10/531,798

(22) PCT Filed: Oct. 14, 2003

(86) PCT No.: PCT/CN03/00857

§ 371 (c)(1),
(2), (4) Date: Apr. 18, 2005

(87) PCT Pub. No.: WO2004/035846

PCT Pub. Date: Apr. 29, 2004

(65) Prior Publication Data

US 2006/0037437 A1 Feb. 23, 2006

(30) Foreign Application Priority Data

Oct. 17, 2002 (CN) ..... 02 2 44470
Apr. 14, 2003 (CN) ..... 03 1 09561

(51) Int. Cl.
*C22B 30/00* (2006.01)

(52) U.S. Cl. ..... 266/168; 266/200

(58) Field of Classification Search ..... 423/47, 423/88, 567.1; 266/168, 200
See application file for complete search history.

(56) References Cited

U.S. PATENT DOCUMENTS 2,596,580 A * 5/1952 McKay et al. ..... 423/29
2,650,159 A * 8/1953 Tarr, Jr., et al. ..... 423/29

FOREIGN PATENT DOCUMENTS

| | | |
|---|---|---|
| CN | 1045379 | 9/1990 |
| CN | 1096058 | 12/1994 |
| CN | 1184856 | 6/1998 |
| CN | 1363696 | 8/2002 |

* cited by examiner

*Primary Examiner*—Steven Bos
(74) *Attorney, Agent, or Firm*—Ladas and Parry LLP

(57) ABSTRACT

A method of vacuum and pollution-free arsenic extraction, wherein increase the temperature of smelting chamber to 100-300° C. and then hold the temperature to remove the vapor and small quantity of dust in the arsenic concentrate; Under residual pressure≦50 Pa, increase the temperature of smelting chamber and crystallization chamber to 300-500° C. and then hold the temperature to remove the volatilized arsenic sulfides; Hold the temperature of crystallization chamber, increase the temperature of smelting chamber to 500-600° C. and then hold the temperature to remove the gaseous element sulfur decomposed; Increase the temperature of smelting chamber to 600-760° C. and then hold the temperature, lower the crystallization chamber temperature to 270-370° C. and then hold the temperature to get element arsenic; shutdown, lower the temperature, charge the air, stripe arsenic product and conduct deslagging, and extract fine gold using conventional method. This invention also provides devices for the above mentioned method, including induction heating equipment, smelting device, constant temperature crystallization device, automatic hydraulic deslagging device, dust collection device, automatic temperature control device, vacuum measuring device and vacuum extraction device. Through large-scale production experiments, this invention completely solves the arsenic pollution and safety problems long existed in the process of arsenic smelting, and simplifies the process.

15 Claims, 3 Drawing Sheets

APPARATUS AND PROCESS FOR EXTRACTING ARSENIC IN VACUUM

TECHNICAL FIELD

This invention concerns a method of vacuum and pollution-free arsenic extraction, especially concerns a method to directly extract arsenic from the arsenopyrite concentrate or discarded arsenic tailing concentrate; this invention also concern a system of vacuum and pollution-free arsenic extraction.

TECHNOLOGY BACKGROUND

The existing arsenic smelting methods are all normal pressure roasting reduction methods. So-called normal pressure means the air pressure in the furnace equal to the atmospheric pressure outside the furnace with connected air flow inside and outside the furnace. So-called reduction means that the arsenic extraction furnace must take $As_2O_3$ as raw material. That is, the minerals shall first be subject to oxidizing roasting to produce $As_2O_3$, which is then reduced to element arsenic under high temperature with electric reduction furnace and carbon. The shortcomings of such arsenic extraction method include: (1) The waste slag has arsenic oxides with big toxicity, which is unavoidable to cause pollution to the underground water and air. (2) The iron arsenate and arsenic oxides generated in the roasting process are left in the slag, leading to both big slag toxicity and low arsenic recovery. (3) $SO_2$ concentration generated in the process of roasting cannot meet the requirement of acid making. The usual $SO_2$ treatment by spraying lime water cannot reach the $SO_2$ discharge standard. (4) In the process of mineral roasting till generating arsenic, each operating step cannot avoid the environment pollution.

To overcome the above disadvantages of using the $As_2O_3$ as raw material to produce element arsenic in the normal pressure reducing furnace, some research units made some small tests to directly extract element arsenic from arsenic concentrate by means of the vacuum process, such as the kilogram level test to remove arsenic from the cobalt ore in the existing technologies (China Non-ferrous Metal Journal, Book 4 Issue 1, 1993), which aimed at creating conditions for the next-step wet method extraction of element cobalt. The test theory was to enable thermal decomposition of the Co, Fe, Ni and As compound in the cobalt concentrate under vacuum conditions and separate out element arsenic. The experimental conditions were: residual pressure 6-10 Pa and temperature 1100-1200° C. But the experimental result had many problems: (1) Arsenic grade cannot meet the international requirement of 99% of arsenic and can only reach 76-92% of crude arsenic. Even the further distillation was also hard to reach the product requirement and involved high cost. (2) Since the smelting temperature was up to 1100-1200° C. and materials were under semi-molten state, it was difficult to discharge slag for application in industrial production. (3) The exhaust issue has not been solved. When arsenic vapor and vapor were generated in the furnace, they would cause the splash of molten materials and produce large quantity of dust polluting the arsenic product and hard to get qualified arsenic. (4) Arsenic content in the slag was up to 10-18%, which brought not only low arsenic recovery, but also the problem of further dearsenization requirement in the subsequent smelting sequence.

Another example is some medium and small tests made by means of existing horizontal type horizontal type rotary vacuum furnace to extract element arsenic from arsenopyrite ore, which still has many problems and has not been used for industrial product till now. Main problems are as follows: (1)

The arsenic corrosion problem of rotary furnace has not been solved, leading to low furnace life and being not suitable for industrial production. (2) The furnace rotation generates large quantity of dust in the process of continuous stirring of materials, which seriously pollutes the product and is its second fatal weakness. (3) The exhaust problem has not been solved. Under high temperature, vapor generated from crystal water in materials directly enters the vacuum unit, often enables the impossible normal operation of vacuum pump and also leads to failure of vacuum solenoid valve. The requirement on vacuum degree cannot be guaranteed. Sometimes, the water accumulated in the vacuum pump leads to the oxidization of pump parts and rejection of vacuum pump. These accidents happened often lead to leakage of vacuum system and $As_2O_3$ pollution. (4) Due to continuous rotation of furnace shell, it is very difficult to measure the actual temperature in the rotary body. Plus, such furnace type integrates smelting chamber and crystallization chamber in the same furnace shell. It is more difficult to control temperature at connection between both chambers. (5) Deslagging and product stripping cannot be conducted at the same time. It must first conduct product stripping and then deslagging, which greatly extends the operating time. (6) Since the effective charging size of smelting chamber (material chamber) of horizontal type rotary furnace is small, and must be less than half the actual size of smelting chamber, otherwise, the materials will flow out of the vent hole (i.e. charging hole) upon rotation and continuously flow into the crystallization chamber and mix with the product. The above problems lead to the fact that the horizontal type rotary vacuum furnace cannot be used for industrial production.

Another example is given 100 g small tests made by arsenopyrite ore under vacuum conditions through thermal decomposition and extraction of element arsenic. The test ore charge is pure arsenopyrite ore. Firstly, the mineral is subject to cleaning to remove most impurities, and subject to leaching with the Iron(III) sulfate to remove $FeS_2$ and other sulfides and get pure arsenopyrite ore as charging material. Although the qualified element arsenic can be got, it is easy to realize for small tests using pure arsenopyrite ore as charging material, and industrial production cannot meet such strict conditions. And the 100 g level vacuum furnace has its integrated smelting chamber, crystallization chamber and dust chamber. After furnace shutdown and temperature lowering, the particles of element arsenic are removed from the shell wall (crucible wall). Such tests can only show that the established fact of vacuum thermal decomposition and extraction of element arsenic.

Someone also made tests to adopt minor negative pressure operation in the furnace and enable thermal decomposition of arsenopyrite ore and extraction of element arsenic. So-called minor negative pressure is that the pressure difference between inside and outside the furnace is about 10 mm water columns. But the minor negative tests can also only show the established fact of thermal decomposition of arsenopyrite ore and extraction of element arsenic, and cannot eliminate the conditions of generating $As_2O_3$, far away from the industrial production.

CONTENTS OF INVENTION

The purpose of this invention is to provide a method of vacuum and pollution-free arsenic extraction; another purpose of this invention is to provide the system used in the method of vacuum and pollution-free arsenic extraction.

To overcome the above defects, a method of vacuum and pollution-free arsenic extraction provided in this invention involves following steps in turn:

(1) Load the arsenic concentrate and iron powder into the smelting chamber;

(2) Increase the temperature of smelting chamber to 100° C.-300° C. and then hold the temperature to remove the vapor and small quantity of dust in the material;

(3) Under residual pressure≦50 Pa, increase the temperature of smelting chamber and crystallization chamber to 300-500° C. and then hold the temperature to remove the volatilized arsenic sulfides in the material;

(4) Hold the temperature of crystallization chamber at 300-500° C., increase the temperature of smelting chamber to 500-600° C. and then hold the temperature to remove the gaseous element sulfur decomposed from material;

(5) Increase the temperature of smelting chamber to 600-760° C. and then hold the temperature, meanwhile lower the temperature of crystallization chamber to 270-370° C. and then hold the temperature to let the arsenic vapor generated from material to crystallize in the crystallization chamber and get element arsenic;

(6) Lower the temperature of smelting chamber and crystallization chamber to below 150° C., and charge the air, when the inside and outside air pressures are basically equal, strip arsenic and conduct deslagging;

Put the arsenic concentrate material into the crucible. To restrict the discharge of element sulfur causing polluted arsenic product, add quantity of iron powder into the material to fix sulfur, i.e. Fe+S=FeS, let the sulfur stay in the slag by form of FeS, tighten the mounting nuts 12 of crystallization chamber, start the induction heating equipment. When the temperature rises to 100-300° C. and then hold the temperature, vapor generated in the mineral along with small quantity of dust gathers into the center multi-slant-hole collecting and exhaust pipe 9, and connect the vapor drainage pipe 1 to the exhaust fan, enabling vapor along with small quantity of dust to drain out of furnace through bottom tightening screw 27 and vapor drainage pipe 1, and ensuring no pollution of crystallization chamber and vacuum system by vapor and dust. After the vapor is exhausted, block the vapor drainage outlet and continue increasing temperature.

Using the induction heating equipment to increase temperatures of smelting chamber and crystallization chamber to 300-500° C. and then hold the temperature, letting arsenic sulfide in material sharply volatilize into gaseous state (such as $As_2S_2$, $As_4S_4$, $As_2S_3$, etc.) and gather to the center of collecting and exhaust pipe 9 via its slant hole and continuously flow into the crystallization chamber. Now, since the temperature of crystallization chamber is about 300-500° C., arsenic sulfide vapor cannot stay in crystallization chamber due to high vapor pressure, and continue flowing into the dust chamber, which can be exhausted regularly from the dust exhaust hole from dust collector and recycled as a byproduct.

Hold the temperature of crystallization chamber at the above 300-500° C., increase the temperature of smelting chamber to 500-600° C. and then hold the temperature, to let the $FeS_2$ decompose a S:$FeS_2$=FeS+S (gas), sulfur and iron powder in raw material combine into FeS, and let sulfur stay in the slag by form of FeS.

After the sulfur is completely solidified and various arsenic sulfides are discharged into the dust chamber, continue increasing the temperature of material to 600-760° C. Material begins sharp decomposition and generates element arsenic vapor:

$$FeAsS=Fes+As(gas)\quad FeAsS_2=Fes+As(gas)+S(gas)$$

Now, hold the temperature of smelting chamber at 600-760° C. and crystallization chamber at 270-370° C. Due to the action of center multi-slant-hole collecting and exhaust pipe 9, arsenic vapor at any point in the material may discharge into the center of exhaust pipe via the nearest slant holes and form continuous arsenic gas flow that flows upward into the constant temperature crystallization chamber, and crystallize on the multi-hole crystallization plate 15 into α arsenic product. In the whole process of continuous entry of arsenic vapor into the crystallization chamber, the temperature of crystallization chamber must be controlled within 270-370° C. If the temperature is too high, arsenic vapor will flow into dust chamber and no product will be got. If the temperature is too low, β arsenic and γ arsenic will be got, rather than α arsenic product.

Shut down, lower temperature and strip product. When the arsenopyrite in the material is completely decomposed without output of arsenic vapor, adopt temperature lowering measures for both interior and exterior shells of crystallization chamber. When the temperature is lowered below 150° C., charge air into the air charging valve 11, till the zero height difference of mercury column of U type pressure gauge, the crystallization chamber can be opened to strip product, and conduct deslagging. Prepare for the next operation cycle.

In the above mentioned method of vacuum and pollution-free arsenic extraction, before material is charged into the above mentioned smelting chamber, there is a step to crush the arsenic concentrate material into grain size of 0.1 mm-2 mm.

In the above mentioned method of vacuum and pollution-free arsenic extraction, the weight of above mentioned iron powder is 2-4% of arsenic concentrate material.

In the above mentioned method of vacuum and pollution-free arsenic extraction, holding time is 1-2 hours in the above step (2).

In the above mentioned method of vacuum and pollution-free arsenic extraction, holding time is 1-2 hours in the above step (3).

In the above mentioned method of vacuum and pollution-free arsenic extraction, holding time is 1-3 hours in the above step (4).

In the above mentioned method of vacuum and pollution-free arsenic extraction, holding time of smelting chamber and crystallization chamber is respectively 3-7 hours in the above step (5).

In the above mentioned method of vacuum and pollution-free arsenic extraction, preferred temperature of smelting chamber in the above step (2) is 200-300° C., and more preferred temperature is 250-300° C.

In the above mentioned method of vacuum and pollution-free arsenic extraction, preferred temperature of smelting chamber in the above step (3) is 450-500° C.

In the above mentioned method of vacuum and pollution-free arsenic extraction, preferred temperature of crystallization chamber in the above step (3) is 400-450° C.

In the above mentioned method of vacuum and pollution-free arsenic extraction, preferred temperature of smelting chamber in the above step (4) is 550-600° C.

In the above mentioned method of vacuum and pollution-free arsenic extraction, preferred temperature of crystallization chamber in the above step (4) is 400-450° C.

In the above mentioned method of vacuum and pollution-free arsenic extraction, preferred temperature of smelting chamber in the above step (5) is 650-750° C., and more preferred temperature is 700-750° C.

In the above mentioned method of vacuum and pollution-free arsenic extraction, the temperature of crystallization chamber in the above step (5) is 300-360° C.

This invention provides a kind of system of vacuum and pollution-free arsenic extraction, including induction heating equipment, smelting device, constant temperature crystallization device, automatic deslagging device, dust collection device, automatic temperature control device, vacuum measuring device and vacuum extraction device. The above mentioned constant temperature crystallization device is fixed on the above mentioned smelting device through demountable device. Its interior smelting chamber is connected with the crystallization chamber of the above mentioned constant temperature crystallization device. Its bottom is connected with the above mentioned automatic deslagging device. The above mentioned smelting device, constant temperature crystallization device and automatic deslagging device have vacuum sealing in between. The above mentioned constant temperature crystallization device is connected with the above mentioned dust collection device through the dust collection inlet pipe. Such dust collection device is connected with the above mentioned vacuum extraction device through pipe equipped with the vacuum measuring device. Inductor on the above mentioned induction heating equipment is arranged on the above mentioned smelting device. The thermal couples 5 of above mentioned automatic temperature control device are respectively mounted on the above mentioned smelting device and constant temperature crystallization device.

In the above mentioned system of vacuum and pollution-free arsenic extraction, the above mentioned smelting device consists of: crucible formed by detachable bottom 8', cover and wall 8, vacuum furnace shell 7 assembled outside the crucible, as well as a hollow collecting and exhaust pipe 9 vertically mounted at the center of the above mentioned crucible bottom 8'. The interior wall of the above mentioned crucible and exterior wall of the above mentioned collecting and exhaust pipe 9 form the above mentioned smelting chamber, which connects with the above mentioned crystallization chamber through the top of the above mentioned collecting and exhaust pipe 9. Downward slant holes are evenly distributed on the wall of such collecting and exhaust pipe 9. A vapor drainage pipe 1 is also installed under such collecting and exhaust pipe 9, which crosses the above mentioned crucible bottom 8' and connects with an exhaust fan.

In the above mentioned system of vacuum and pollution-free arsenic extraction, the centerline of each slant hole of the above mentioned collecting and exhaust pipe 9 and the centerline of the above mentioned collecting and exhaust pipe 9 are in the same plane and form 20-40 degree bevel with the lower end face of the above mentioned collecting and exhaust pipe 9.

In the above mentioned system of vacuum and pollution-free arsenic extraction, the above mentioned crucible is made of corrosion proof and heat conducting material, preferably made of graphite.

In the above mentioned system of vacuum and pollution-free arsenic extraction, the inductor of the above mentioned induction heating equipment is of intermediate frequency inductor. Such intermediate frequency inductor is in integral cast in the insulating materials and assembled in the vacuum furnace shell 7 outside the above mentioned crucible. The above mentioned induction heating equipment also includes intermediate frequency power, capacitor for electric induction heating system, intermediate frequency isolating transformer. The above mentioned intermediate frequency isolating transformer is connected between the electric input end of the above mentioned intermediate frequency inductor and intermediate frequency power.

In the above mentioned system of vacuum and pollution-free arsenic extraction, the inductor of the above mentioned induction heating equipment is of intermediate frequency inductor. Such inductor is assembled outside the above mentioned vacuum furnace shell 7. The above mentioned induction heating equipment also includes intermediate frequency power and capacitor for electric induction heating system.

In the above mentioned system of vacuum and pollution-free arsenic extraction, the above mentioned vacuum furnace shell 7 is made of high temperature resistant, insulation, non-magnetoconductive, non conducting and non-leakage material, preferably made of ceramic or 4-fluorothene plastic wire mesh.

In the above mentioned system of vacuum and pollution-free arsenic extraction, insulating material is used to block the gap between the above mentioned crucible wall 8 and the above mentioned vacuum furnace shell 7.

In the above mentioned system of vacuum and pollution-free arsenic extraction, the above mentioned constant temperature crystallization device includes bottomless shell 14 and inner shell 13, many multi-hole crystallization plates 15 installed on one support as well as center heating pipe 16 installed on the above mentioned shell 14 and extending at the vertical direction in the center of shell. The space in the above mentioned inner shell 13 forms the above mentioned crystallization chamber. The above mentioned inner shell 13 and support of multi-hole crystallization plate 15 are fixed together with the above mentioned shell 14 through the dismountable device.

In the above mentioned system of vacuum and pollution-free arsenic extraction, a minor annular slit exists between the shell 14 and inner shell 13 of the above mentioned constant temperature crystallization device. The bottom of the above mentioned annular slit is plugged with refractory materials.

In the above mentioned system of vacuum and pollution-free arsenic extraction, the above mentioned automatic temperature control device includes: a thermal couple 5 inserted on the crystallization chamber shell 14 for measuring temperature in the crystallization chamber, a thermal couples 5 inserted at the furnace bottom 6 for measuring temperature of smelting chamber, as well as temperature controller connected with the above two thermal couples 5 and the above mentioned induction heating equipment through compensation cord for respectively controlling the temperature in the furnace and crystallization chamber.

In the above mentioned system of vacuum and pollution-free arsenic extraction, the above mentioned smelting device is installed above the ground through the support 24. Such smelting device also includes a furnace bottom 6 fixed with the above mentioned crucible bottom 8'; the above mentioned automatic deslagging device includes: hopper 4, slag car 3 as well as hydraulic lift 2 installed on the hopper 4. The above mentioned furnace bottom 6 is connected with vacuum furnace shell 7 through top support of the hydraulic lift 2, between which the vacuum sealing strips are used for vacuum sealing. Upon lowering, such hydraulic lift 2 can separate the above mentioned furnace bottom 6 and the above mentioned crucible bottom 8' from the above mentioned crucible wall 8.

In the above mentioned system of vacuum and pollution-free arsenic extraction, a layer of heat insulation material is arranged between the above mentioned crucible bottom 8' and the above mentioned furnace bottom 6.

DETAILED EMBODIMENTS

Now, further explanations on the method of vacuum and pollution-free arsenic extraction provided in this invention and the system of vacuum and pollution-free arsenic extraction provided in this invention are given in combination with the drawings.

Figure 2:
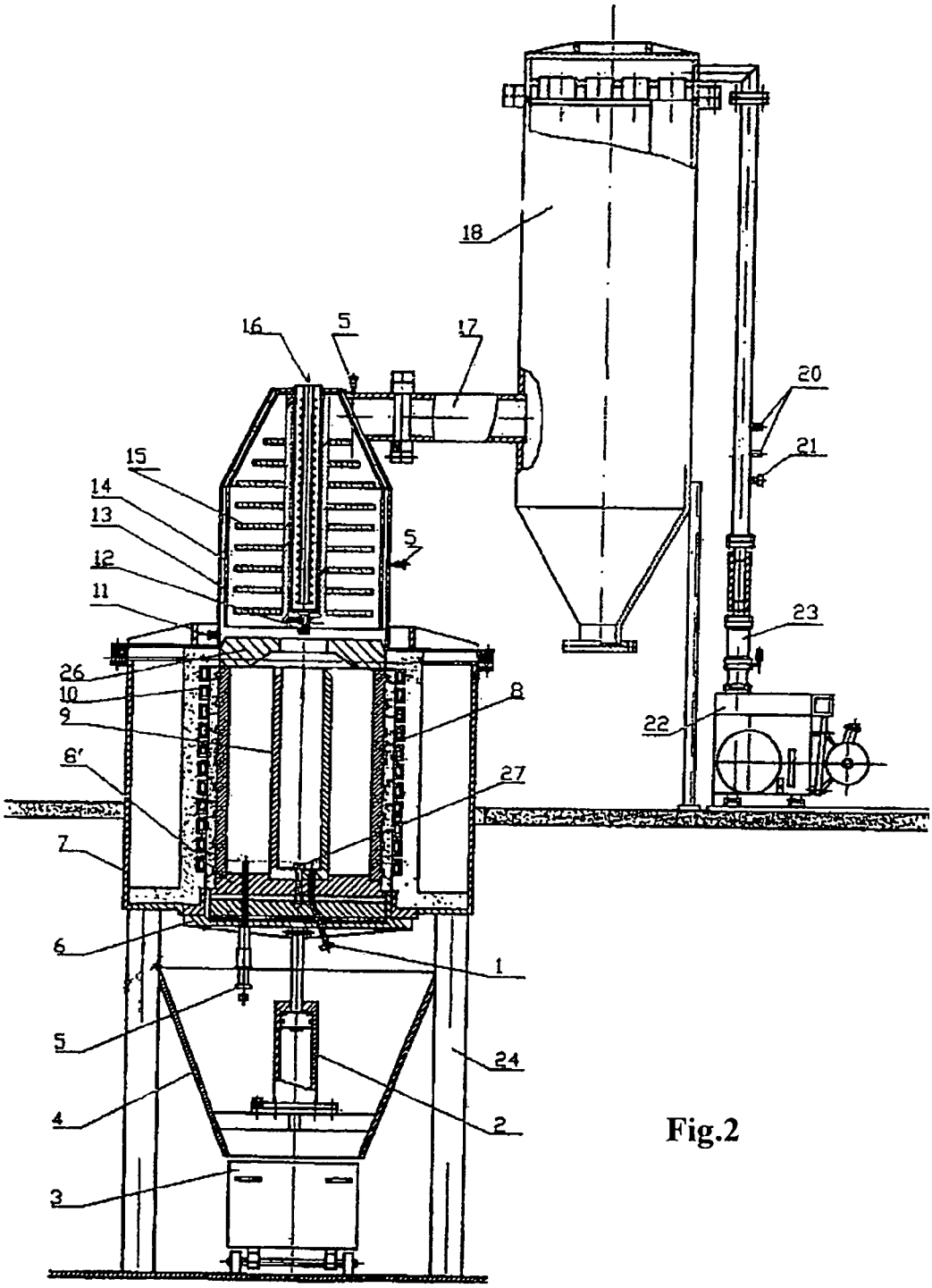
FIG. 2 is one structural representation of the system of vacuum and pollution-free arsenic extraction provided in this invention.

Please refer to one structural representation of the system of vacuum and pollution-free arsenic extraction provided shown in FIG. 2, brief explanations on structural features and operating principle of major equipment in this invention are made.

In the system of vacuum and pollution-free arsenic extraction provided in this invention, smelting device is connected with the constant temperature crystallization device through bolts and nuts, between which the rubber strip is used for vacuum sealing; smelting device is connected with the automatic deslagging device with hydraulic operated furnace bottom through hydraulic lift 2; the constant temperature crystallization device is connected with the dust collection device through left flange of dust collection inlet pipe 17, "O" rubber ring is used between left and right flanges for vacuum sealing; the dust collection device is connected with the vacuum extraction device through stainless steel pipe and solenoid valve 23; the intermediate frequency induction heating equipment is connected with the smelting device through the inductor 10, inductor 10 and intermediate frequency heating device are connected through flexible cable; the temperature controlling device is connected with all temperature control instruments through thermal couples 5 and compensation flexible conductor. Thyristor is controlled through information feedback of thermal couples 5 to automatically adjust power and control temperature; the pressure measuring device is connected with the macleod gauge and U type pressure gauge with vacuum hose and pressure sensing tube connector 20 to read the vacuum degree.

Intermediate frequency heating part 10 is put in stainless steel vacuum furnace shell 7 on the vacuum furnace support 24. To prevent vacuum discharge, on the one hand, the whole intermediate frequency inductor must be cast and sealed with insulating material to prevent inductor shorted to earth. On the other hand, the intermediate frequency isolating transformer is connected between the electric input end of the intermediate frequency inductor and intermediate frequency power to lower the intermediate frequency output voltage and further prevent the vacuum discharge in the furnace.

A hollow collecting and exhaust pipe 9 is vertically installed at the center of graphite crucible bottom 8'. Its top is connected with the constant temperature crystallization device and enables the fixed connection between multi-slant-hole collecting and exhaust pipe 9 and graphite crucible bottom 8'. Upward slant holes are evenly distributed on the collecting and exhaust pipe. Each slant hole forms 30 degree bevel with the lower end face of collecting and exhaust pipe. The role of these slant holes is to enable various gases generated by materials in the furnace to gather to the center of collecting and exhaust pipe in the shortest distance and minimum flow resistance, enter the multi-hole crystallization plate 15 of constant temperature crystallization chamber from the collecting and exhaust pipe, and crystallize into the arsenic product. The center collecting and exhaust pipe can greatly reduce the flow resistance of various gases generated by the melted materials, such as arsenic vapor, steam, various arsenic sulfide vapors and so on, and also minimize the arsenic content in the slag. A vapor drainage pipe 1 is under such collecting and exhaust pipe 9, crosses the above mentioned graphite crucible bottom 8' and connects with the exhaust fan.

The automatic deslagging device with hydraulic operated furnace bottom includes slag car 3, slag hopper 4, hydraulic lift 2 and lifting furnace bottom 6. Such lifting furnace bottom 6 is fixed with the graphite crucible bottom 8' through insulating material layer. The furnace bottom 6 is connected with the stainless steel vacuum furnace shell 7 through the support of hydraulic lift 2, between which the vacuum rubber strips are used for vacuum sealing. The hydraulic lift 2 drives the furnace bottom 6 and graphite crucible bottom 8' to separate from the above mentioned graphite crucible wall 8. The hydraulic lift 2 upward supports such furnace bottom 6 to compact the vacuum rubber strips between such furnace bottom 6 and stainless steel vacuum furnace shell 7 and fulfill vacuum sealing. The lifting of furnace bottom arrives at the purpose of automatic deslagging. The reason why deslagging by means of lifting the furnace bottom is because the smelting temperature≦760° C., any substances in the material are far from the melting conditions and the slag is dry and of the same flow property with the original material.

Center heating pipe 16 extending in vertical direction is installed at the center of constant temperature crystallization chamber, on the crystallization chamber shell 14 and shell center. Several equidistant multi-hole crystallization plates 15 are installed at one tubular support. Such tubular support is also assembled outside the above mentioned center heating pipe 16. The crystallization chamber inner shell 13 and multi-hole crystallization plate 15 are fixed with the crystallization chamber external shell 14 through bolts and nuts 12. Screwing off the nut 12 can take off all multi-hole crystallization plates and crystallization chamber inner shell so as to strip product. There is a minor annular slit between such crystallization chamber inner shell 13 and external shell 14 to facilitate removing the crystallization chamber inner shell 13. Since arsenic vapor is not allowed to enter such slit for crystallization, otherwise, it will cause the accident of blocking the inner shell 13. To prevent such accident, the spongeous refractory materials shall be properly plugged into the lower end of such annular slit.

The temperature control of smelting chamber is fulfilled by means of thermal couples 5 installed at the lifting furnace bottom 6 for information feedback to the temperature controlling device on the intermediate frequency induction heating equipment. And the thyristor in the temperature controlling device can automatically adjust the intermediate frequency voltage in the thyristor according to the feedback information, i.e. adjusting the output power of intermediate frequency to arrive at the purpose of temperature control. The constant temperature crystallization chamber has dedicated and independent temperature controlling device for temperature control. Its temperature control principle is the same as that of smelting chamber, using thermal couples 5 installed at the crystallization chamber external shell 14 for information feedback. The temperature controlling device automatically adjusts the heating power of electric furnace heating wires wound on the center heating pipe 16 according to the changing information to arrive at the purpose of temperature control of crystallization chamber. The electric furnace heating wires on the heating pipe must be completely isolated with the arsenic vapor from arsenic corrosion. The above mentioned tubular support plays the role of isolating the arsenic vapor from entry into the center heating chamber.

The constant temperature crystallization chamber external shell 14 is connected with the dust collector shell 18 through the dust collection inlet pipe 17. When the temperature rises to 300-500° C., various arsenic sulfides volatilized from materials enter the dust chamber and are discharged through dust exhaust hole as byproducts.

The top of dust chamber 18 is connected into the vacuum extraction system with the stainless steel extraction pipe. By starting the vacuum unit 22, the whole integrated system arrives at the vacuum requirement through vacuum solenoid valve 23 and stainless steel extraction pipe. The air charging valve 21 can be used to carry out system charging leakage check. The system vacuum degree can be measured by use of U type pressure gauge and macleod gauge connected on the pressure measuring pipe 20.

Figure 3:
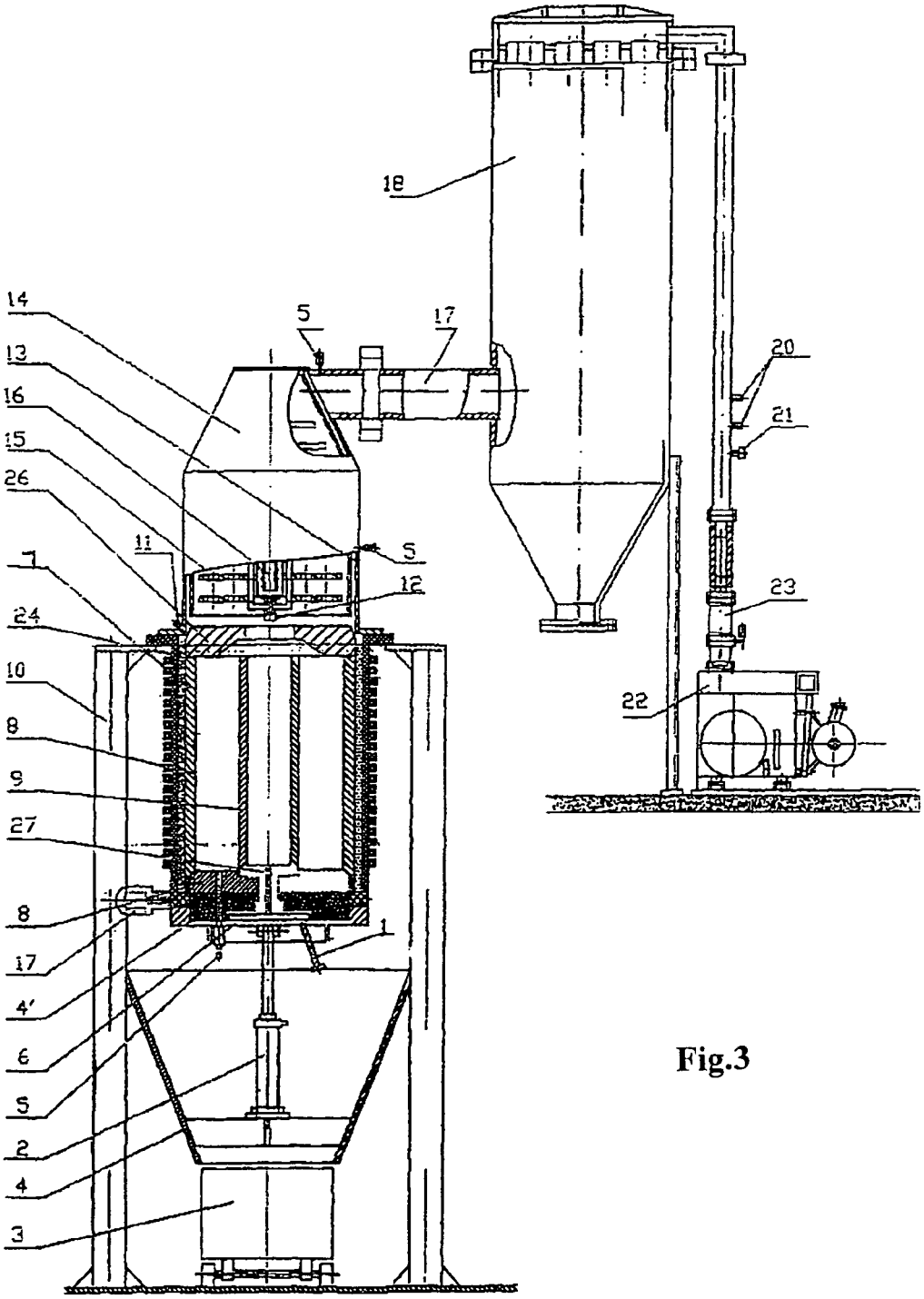
FIG. 3 is another structural representation of the system of vacuum and pollution-free arsenic extraction provided in this invention.

Please refer to another structural representation of the system of vacuum and pollution-free arsenic extraction provided shown in FIG. 3, brief explanations on another structural features and operating principle of smelting device are given below. The installation descriptions of other devices are the same as those of FIG. 2.

It is put inside the ceramic vacuum furnace shell 7 on the vacuum furnace support 24 and fixed with screw 13 and furnace shell fixing screw 17. Since the tailor-made industrial ceramic furnace shell can not only meet the requirement of no leakage under high vacuum, but also meet the special non-magnetoconductive, non conducting, high temperature resistant and high strength requirement required by electric magnetic induction heating, it is allowed to assemble the inductor 10 outside the industrial ceramic furnace shell 7. Such structure can completely eliminate the phenomenon of vacuum discharge, improve the operating reliability of heating system, and also get rid of the intermediate frequency isolating transformer required by conventional vacuum furnace for preventing the vacuum discharge and save the power consumption of isolating transformer. More significantly: in case the stainless steel is used as the vacuum furnace shell, it has to put the inductor inside the stainless steel shell, leading to magnetic induction heating of stainless steel shell and adding useless power consumption. This invention adopts tailor-made ceramic vacuum furnace shell, whose total power consumption may be saved by 20-30% under the same power.

The graphite crucible wall 8, graphite crucible bottom 8' and graphite crucible cover 26 are installed in the ceramic vacuum furnace shell 7. A hollow collecting and exhaust pipe 9 is vertically installed at the center of graphite crucible bottom 8'. Annular slit between ceramic shell and graphite crucible is plugged with insulating material 4.

Taking the arsenopyrite concentrate as material, further descriptions on this method are made through following experimental data:

TABLE 1

Influence of Grain Size of Arsenic Concentrate Material on Arsenic Volatilization Amount

| | | | | | |
|---|---|---|---|---|---|
| Arsenic volatilization amount | kg | 650 | 740 | 796 | 848 |
| | % | <75% | <85% | ≦91% | 97% |
| Grain size (mm) | | 5-10 | 3-5 | 1-3 | 0.1-2 |
| Temperature (° C.) | | 750 | | | |
| Residual pressure (Pa) | | 1-50 | | | |
| Charge (kg) | | 2500 | | | |
| Distillation time (h) | | 4 | | | |
| Concentrate arsenic grade (%) | | 35 | | | |

It is seen from Table [1] that in the event of unchanged conditions like temperature and residual pressure, when the grain size is 0.1-2 mm, the optimum distillation effect can be got.

To show the relation between arsenic sulfide volatilization rate and temperature, we made a test by the mini vacuum furnace. The test result is listed in Table [2].

TABLE 2

Influence of Temperature on Arsenic Sulfide Volatilization Rate

| | | | | | |
|---|---|---|---|---|---|
| Arsenic sulfide volatilization amount | g | 1 | 5 | 9.5 | 9.8 |
| | % | 10% | 50% | 95% | 100% |
| Temperature (° C.) | | 300 | 400 | 450 | 500 |
| Grain size (mm) | | 0.1-2 | | | |
| Residual pressure (Pa) | | 50 | | | |
| Charge (g) | | 100 | | | |

TABLE 2-continued

Influence of Temperature on Arsenic Sulfide Volatilization Rate

| | |
|---|---|
| Distillation time (min) | 30 |
| Arsenical sulfide grade (%) | 10 |

It is seen from Table [2] that when the temperature is at 450° C., within 30 minutes, 95% arsenic sulfides have been volatilized. If time is extended further, 100% will be volatilized. So, 450-500° C. is the optimum decomposition temperature of arsenic sulfides.

To show the relation between $FeS_2$ decomposition and temperature, the mini vacuum furnace is also used to make a test. The test result is listed in the Table [3].

TABLE 3

Relation Between $FeS_2$ Decomposition and Temperature

| | | | | | | |
|---|---|---|---|---|---|---|
| Separated sulfur amount | g | 0 | 0.53 | 4.24 | 5.2 | 5.3 |
| | % | 0 | 10% | 80% | 98% | 100% |
| Temperature (° C.) | | 300 | 450 | 500 | 550 | 600 |
| Grain size (mm) | | 0.1-2 | | | | |
| Residual pressure (Pa) | | 50 | | | | |
| Charge (g) | | 100 | | | | |
| Distillation time (h) | | 1 | | | | |
| FeS grade (%) | | 20 | | | | |

It is seen from Table [3] that when the temperature is 550° C., large amount of $FeS_2$ may be decomposed: $FeS_2$=FeS+S (gas), up to 98% at such temperature. If time is extended further, 100% will be decomposed. So, 550-600° C. is the optimum decomposition temperature of $FeS_2$.

TABLE 4

Influence of Temperature on Arsenic Volatilization Amount

| | | | | | |
|---|---|---|---|---|---|
| Arsenic volatilization amount | Kg | 175 | 350 | 700 | 860 |
| | % | 20% | 40% | 80% | >98% |
| Temperature (° C.) | | 550-600 | 600-650 | 650-700 | 700-750 |
| Grain size (mm) | | 0.1-2 | | | |
| Residual pressure (Pa) | | 1-50 | | | |
| Charge (g) | | 2500 | | | |
| Distillation time (h) | | 4 | | | |
| Concentrate arsenic grade (%) | | 35 | | | |

It is seen from Table [4] that in the event of unchanged conditions like grain size and residual pressure, when the temperature is 650-700° C., the arsenic volatilization is up to 80%; when the temperature is 700-750° C., the arsenic volatilization is up to the maximum amount. The slag now is still of dry slag without caking and melting. It keeps the good flow property with the original material. Apparently, if the distillation time is extended further, the volatilization amount will increase.

Embodiment 1

Figure 1:
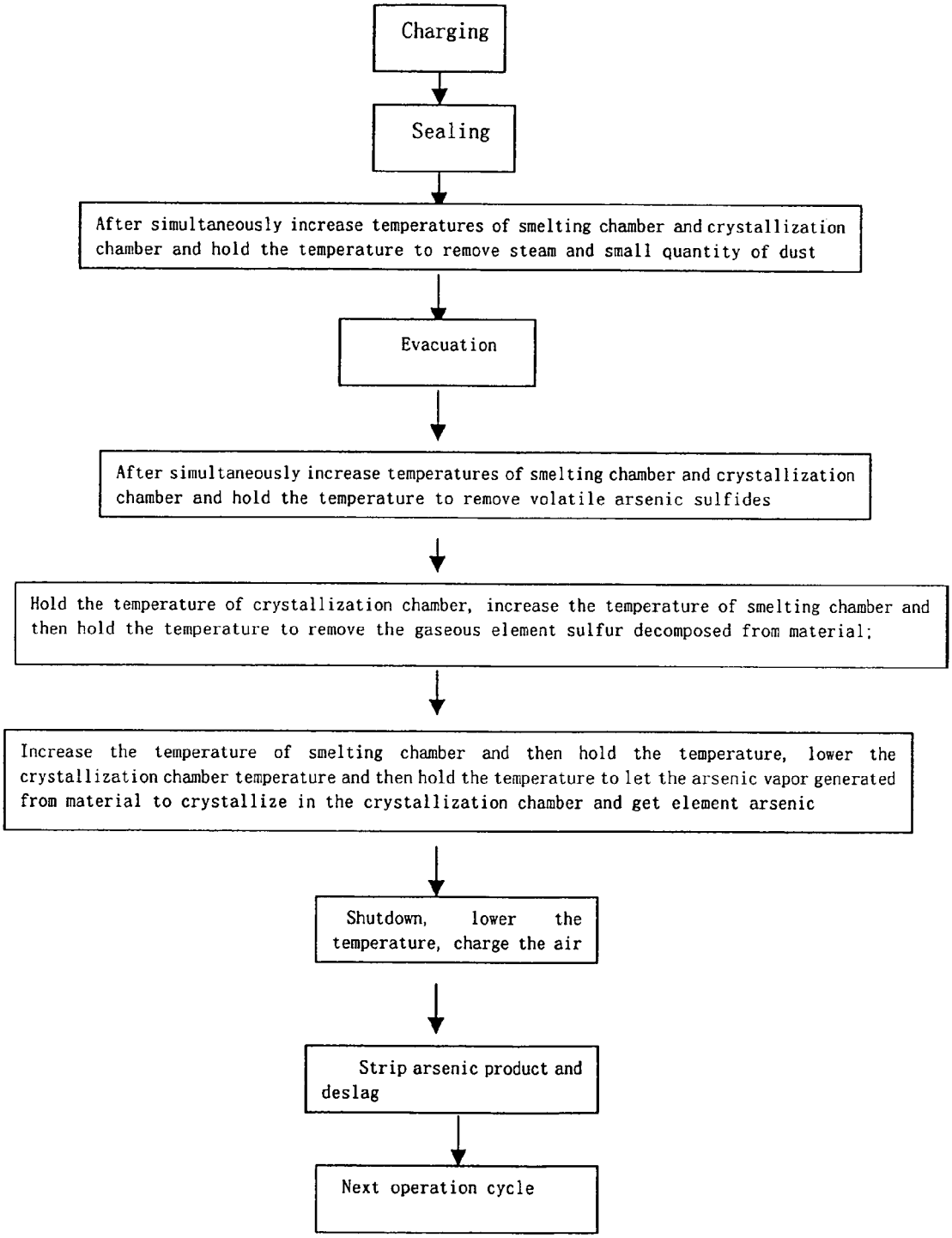
FIG. 1 is the flow diagram of the method of vacuum and pollution-free arsenic extraction provided in this invention.

Please refer to FIG. 1 the flow diagram of the method of vacuum and pollution-free arsenic extraction provided in this invention. Crush 2.5 t arsenopyrite concentrate into 1 mm grain size and put the same into the graphite crucible. Add 62 kg scrap iron powder to fix sulfur and enable it to stay in the slag by form of FeS. Tighten the crystallization chamber mounting nut 12. Start the intermediate frequency heating device. Experimental conditions are shown as Table [5].

Increase the temperature to 100° C. and then hold the temperature for 2 hours to remove the vapor and small quantity of dust in the arsenopyrite concentrate. Vapor along with small quantity of dust generated from the concentrate gather into the center multi-slant-hole collecting and exhaust pipe 9. Connect the vapor drainage pipe 1 to the exhaust fan to discharge vapor and small quantity of dust through furnace bottom tightening screw 27 and vapor drainage pipe 1. When the vapor is drain out, block the vapor drainage hole; continue increasing the temperature to remove the volatilized arsenic sulfides in the arsenopyrite concentrate, and when the temperature of smelting chamber and crystallization chamber rises to 300° C. and then hold the temperature for 2 hours, letting arsenic sulfides in concentrate volatilize into gaseous state (such as $As_2S_2$, $As_4S_4$, $As_2S_3$, etc.) and gather to the center of collecting and exhaust pipe 9 via the slant holes of collecting and exhaust pipe, flow into the crystallization chamber, then to the dust chamber; to remove the decomposed gaseous element sulfur in the arsenopyrite concentrate, hold the crystallization chamber temperature at 300° C., use the intermediate frequency heating device to increase the smelting chamber temperature to 500° C. and then hold the temperature for 2 hours. The decomposed element sulfur combines with scrap iron powder in the raw material into FeS, letting the element sulfur stay in the slag by form of FeS; to get element arsenic in the arsenopyrite concentrate, continue increasing smelting chamber temperature to 600° C. and then hold the temperature for 7 hours, lower the crystallization chamber temperature to 270° C. and then hold the temperature for 7 hours. Generated element arsenic vapor is drained into the center of collecting and exhaust pipe from the nearest slant hole to form arsenic gas flow, which continuously flows into the constant temperature crystallization chamber and crystallize on multi-hole crystallization plate 15 into α arsenic product.

Adopt temperature lowering measures for both interior and exterior shells of smelting chamber and crystallization chamber. When the temperature is lowered below 150° C., charge air into the air charging valve 11, till the zero height difference of mercury column of U type pressure gauge, the crystallization chamber can be opened to strip product, and conduct deslagging. The experimental result is shown as Table [5]. The purity of arsenic product is 80% and concentrate dearsenization rate is 50%.

Embodiment 2

The same experimental steps as Embodiment 1 are adopted. The difference lies in that to remove the vapor and small quantity of dust in the arsenopyrite concentrate, increase the temperature to 150° C. and then hold the temperature for 2 hours; to remove the volatilized arsenic sulfides in the arsenopyrite concentrate, increase the temperature of smelting chamber and crystallization chamber to 320° C. and then hold the temperature for 2 hours; to remove the decomposed gaseous element sulfur in the arsenopyrite concentrate, lower the crystallization chamber temperature to 300° C., and increase the smelting chamber temperature to 530° C. and then hold the temperature for 2 hours; to get the element arsenic in the arsenopyrite concentrate, hold the crystallization chamber at 300° C. for 7 hours, continue increasing the smelting chamber temperature to 630° C. and then hold the temperature for 7 hours. α arsenic product is crystallized on the multi-hole crystallization plate 15. The experimental result is shown as Table [5]. The purity of arsenic product is 82% and concentrate dearsenization rate is 55%.

Embodiment 3

The same experimental steps as Embodiment 1 are adopted. The difference lies in that to remove the vapor and small quantity of dust in the arsenopyrite concentrate, increase the temperature to 200° C. and then hold the temperature for 1.5 hours; to remove the volatilized arsenic sulfides in the arsenopyrite concentrate, increase the temperature of smelting chamber to 350° C., and increase the temperature of crystallization chamber to 300° C., and then hold the temperature for 1.5 hours; to remove the decomposed gaseous element sulfur in the arsenopyrite concentrate, increase the crystallization chamber temperature to 320° C., increase the temperature of smelting chamber to 570° C. and then hold the temperature for 1.5 hours; to get the element arsenic in the arsenopyrite concentrate, lower the crystallization chamber temperature to 300° C. and then hold the temperature for 6 hours, continue increasing the smelting chamber temperature to 650° C. and then hold the temperature for 6 hours. α arsenic product is crystallized ion the multi-hole crystallization plate 15. The experimental result is shown as Table [5]. The purity of arsenic product is 85% and concentrate dearsenization rate is 60%.

Embodiment 4

The same experimental steps as Embodiment 1 are adopted. The difference lies in that to remove the vapor and small quantity of dust in the arsenopyrite concentrate, increase the temperature to 200° C. and then hold the temperature for 1.5 hours; to remove the volatilized arsenic sulfides in the arsenopyrite concentrate, increase the temperature of smelting chamber to 400° C., and increase the temperature of crystallization chamber to 350° C., and then hold the temperature for 1.5 hours; to remove the decomposed gaseous element sulfur in the arsenopyrite concentrate, increase the crystallization chamber temperature to 400° C., increase the temperature of smelting chamber to 600° C. and then hold the temperature for 1.5 hours; To get the element arsenic in the arsenopyrite concentrate, lower the crystallization chamber temperature to 320° C. and then hold the temperature for 6 hours, continue increasing the smelting chamber temperature to 670° C. and then hold the temperature for 6 hours. α arsenic product is crystallized on the multi-hole crystallization plate 15. The experimental result is shown as Table [5]. The purity of arsenic product is 97% and concentrate dearsenization rate is 70%.

Embodiment 5

The same experimental steps as Embodiment 1 are adopted. The difference lies in that to remove the vapor and small quantity of dust in the arsenopyrite concentrate, increase the temperature to 230° C. and then hold the temperature for 1.3 hours; to remove the volatilized arsenic sulfides in the arsenopyrite concentrate, increase the smelting chamber temperature to 400° C., and increase the temperature of crystallization chamber to 300° C., and then hold the temperature for 1.5 hours; to remove the decomposed gaseous element sulfur in the arsenopyrite concentrate, hold the crystallization chamber temperature at 300° C., increase the smelting chamber temperature to 570° C. and then hold the temperature for 2 hours; to get the element arsenic in the arsenopyrite concentrate, hold the crystallization chamber temperature at 300° C. for 6 hours, continue increasing the smelting chamber temperature to 680° C. and then hold the temperature for 6 hours. α arsenic product is crystallized on the multi-hole crystallization plate 15. The experimental result is shown as Table [5]. The purity of arsenic product is 86% and concentrate dearsenization rate is 80%.

Embodiment 6

The same experimental steps as Embodiment 1 are adopted. The difference lies in that to remove the vapor and small quantity of dust in the arsenopyrite concentrate, increase the temperature to 230° C. and then hold the temperature for 1 hour; to remove the volatilized arsenic sulfides in the arsenopyrite concentrate, increase the smelting chamber temperature to 450° C., and increase the temperature of crystallization chamber to 400° C., and then hold the temperature for 1 hour; to remove the decomposed gaseous element sulfur in the arsenopyrite concentrate, hold the crystallization chamber temperature at 400° C., increase the smelting chamber temperature to 600° C. and then hold the temperature for 1 hour; to get the element arsenic in the arsenopyrite concentrate, lower the crystallization chamber temperature to 350° C. and then hold the temperature for 5 hours, continue increasing the smelting chamber temperature to 700° C. and then hold the temperature for 5 hours. α arsenic product is crystallized on the multi-hole crystallization plate 15. The experimental result is shown as Table [5]. The purity of arsenic product is 99% and concentrate dearsenization rate is 90%.

Embodiment 7

The same experimental steps as Embodiment 1 are adopted. The difference lies in that to remove the vapor and small quantity of dust in the arsenopyrite concentrate, increase the temperature to 230° C. and then hold the temperature for 1.3 hours; to remove the volatilized arsenic sulfides in the arsenopyrite concentrate, increase the smelting chamber temperature to 450° C., and increase the temperature of crystallization chamber to 330° C., and then hold the temperature for 1 hour; to remove the decomposed gaseous element sulfur in the arsenopyrite concentrate, increase the crystallization chamber temperature to 450° C., increase the smelting chamber temperature to 550° C. and then hold the temperature for 2.5 hours; to get the element arsenic in the arsenopyrite concentrate, lower the crystallization chamber temperature to 320° C. and then hold the temperature for 4.5 hours, continue increasing the smelting chamber temperature to 730° C. and then hold the temperature for 4.5 hours. α arsenic product is crystallized on the multi-hole crystallization plate 15. The experimental result is shown as Table [5]. The purity of arsenic product is 99% and concentrate dearsenization rate is 94%.

Embodiment 8

The same experimental steps as Embodiment 1 are adopted. The difference lies in that to remove the vapor and small quantity of dust in the arsenopyrite concentrate, increase the temperature to 250° C. and then hold the temperature for 1 hour; to remove the volatilized arsenic sulfides in the arsenopyrite concentrate, increase the smelting chamber temperature to 500° C., and increase the temperature of crystallization chamber to 430° C., and then hold the temperature for 1 hour; to remove the decomposed gaseous element sulfur in the arsenopyrite concentrate, lower the crystallization chamber temperature to 400° C., increase the smelting chamber temperature to 620° C. and then hold the temperature for 1 hour; to get the element arsenic in the arsenopyrite concentrate, lower the crystallization chamber temperature to 350° C. and then hold the temperature for 5 hours, continue increasing the smelting chamber temperature to 730° C. and then hold the temperature for 6 hours. α arsenic product is crystallized on the multi-hole crystallization plate 15. The experimental result is shown as Table [5]. The purity of arsenic product is 99% and concentrate dearsenization rate is 97%.

Embodiment 9

The same experimental steps as Embodiment 1 are adopted. The difference lies in that to remove the vapor and small quantity of dust in the arsenopyrite concentrate, increase the temperature to 280° C. and then hold the temperature for 1 hour; to remove the volatilized arsenic sulfides in the arsenopyrite concentrate, increase the smelting chamber temperature to 480° C., and increase the temperature of crystallization chamber to 450° C., and then hold the temperature for 1 hour; to remove the decomposed gaseous element sulfur in the arsenopyrite concentrate, lower the crystallization chamber temperature to 430° C., increase the smelting chamber temperature to 620° C. and then hold the temperature for 1 hour; to get the element arsenic in the arsenopyrite concentrate, lower the crystallization chamber temperature to 320° C. and then hold the temperature for 3 hours, continue increasing the smelting chamber temperature to 750° C. and then hold the temperature for 3 hours. α arsenic product is crystallized on the multi-hole crystallization plate 15. The experimental result is shown as Table [5]. The purity of arsenic product is 99% and concentrate dearsenization rate is 98%.

Embodiment 10

The same experimental steps as Embodiment 1 are adopted. The difference lies in that to remove the vapor and small quantity of dust in the arsenopyrite concentrate, increase the temperature to 300° C. and then hold the temperature for 1 hour; to remove the volatilized arsenic sulfides in the arsenopyrite concentrate, increase the smelting chamber temperature to 500° C., and increase the temperature of crystallization chamber to 450° C., and then hold the temperature for 1 hour; to remove the decomposed gaseous element sulfur in the arsenopyrite concentrate, hold the crystallization chamber temperature at 450° C., increase the smelting chamber temperature to 620° C. and then hold the temperature for 1 hour; to get the element arsenic in the arsenopyrite concentrate, lower the crystallization chamber temperature to 340° C. and then hold the temperature for 3 hours, continue increasing the smelting chamber temperature to 760° C. and then hold the temperature for 3 hours. α arsenic product is crystallized on the multi-hole crystallization plate 15. The experimental result is shown as Table [5]. The purity of arsenic product is 99% and concentrate dearsenization rate is 98%.

Embodiment 11

The same experimental steps as Embodiment 1 are adopted. The difference lies in that to remove the vapor and small quantity of dust in the arsenopyrite concentrate, increase the temperature to 300° C. and then hold the temperature for 1 hour; to remove the volatilized arsenic sulfides in the arsenopyrite concentrate, increase the smelting chamber temperature to 480° C., and increase the temperature of crystallization chamber to 350° C., and then hold the temperature for 1 hour; to remove the decomposed gaseous element sulfur in the arsenopyrite concentrate, increase the crystallization chamber temperature to 420° C., increase the smelting chamber temperature to 580° C. and then hold the temperature for 1.8 hours; to get the element arsenic in the arsenopyrite concentrate, lower the crystallization chamber temperature to 350° C. and then hold the temperature for 3 hours, continue increasing the smelting chamber temperature to 750° C. and then hold the temperature for 3.5 hours. α-arsenic product is crystallized on the multi-hole crystallization plate 15. The experimental result is shown as Table [5]. The purity of arsenic product is 99% and concentrate dearsenization rate is 98%.

INDUSTRIAL PRACTICABILITY

This invention provides a method of vacuum and pollution-free arsenic extraction, where the atmosphere doesn't involve in the chemical reaction of materials in the furnace under vacuum condition, thus radically eliminating the condition generating virulent $As_2O_3$, and also radically eliminating the condition generating waste gas and wastewater. And waste slag is atoxic (arsenic-free oxides) and iron content in the slag>55% with recycling value. Therefore, this invention absolutely solves the problem of arsenic pollution long existed in the process of arsenic smelting. The method provided in this invention may also be used to extract arsenic from the high-arsenic fume in the non-ferrous metal smeltery to recover valuable metals in the fume; it may also be used for dearsenization treatment of materials requiring dearsenization, which is a breakthrough of environment protection technology in the arsenic smelting industry. Through large-scale production experiments, this invention fulfills its purpose and anticipated effect.

exhaust pipe 9 in the smelting chamber of this vacuum smelting device is installed, avoiding the problems of direct entry of steam generated from crystal water in materials under high temperature into the vacuum unit, which enables the impossible normal operation of vacuum pump and also the failure of vacuum solenoid valve and being unable to guarantee the requirement on vacuum degree, and sometimes, the water accumulated in the vacuum pump leads to the oxidization of pump parts and rejection of vacuum pump; since the system respectively is equipped with smelting device, constant temperature crystallization device, automatic deslagging device and dust collection device, pure product can be got, enabling easy temperature control of the smelting chamber and crystallization chamber and simultaneous deslagging and product stripping; since this system adopts the vertical structure, thus enlarging the effective charging size of smelting chamber. This system overcomes existing problems of horizontal type rotary vacuum furnace and is suitable for industrial production. It features three functions: ① being able to completely decompose arsenic in the arsenopyrite ore under low temperature and get the international standard element arsenic. ② enabling element sulfur decomposed from the arsenopyrite ore or pyrite and various arsenic sulfides volatilized to gather in the dust chamber where such byproduct is got. ③ The whole process of arsenic extraction has no discharge of wastewater, waste gas and toxic slag.

TABLE 5

| Embodiment | Steam drainage and dust exhaust temperature (° C.) | Holding time (h) | Volatile arsenic sulfide temperature (° C.) Smelting chamber | Volatile arsenic sulfide temperature (° C.) Crystallization chamber | Holding time (h) | Sulfur decomposition temperature (° C.) Smelting chamber | Sulfur decomposition temperature (° C.) Crystallization chamber |
|---|---|---|---|---|---|---|---|
| 1 | 100 | 2 | 300 | 300 | 2 | 500 | 300 |
| 2 | 150 | 2 | 320 | 320 | 2 | 530 | 300 |
| 3 | 200 | 1.5 | 350 | 300 | 1.5 | 570 | 320 |
| 4 | 200 | 1.5 | 400 | 350 | 1.5 | 600 | 400 |
| 5 | 230 | 1.3 | 400 | 300 | 1.5 | 570 | 300 |
| 6 | 230 | 1 | 450 | 400 | 1 | 600 | 400 |
| 7 | 230 | 1.3 | 450 | 330 | 1 | 550 | 450 |
| 8 | 250 | 1 | 500 | 430 | 1 | 620 | 400 |
| 9 | 280 | 1 | 480 | 450 | 1 | 620 | 430 |
| 10 | 300 | 1 | 500 | 450 | 1 | 620 | 450 |
| 11 | 300 | 1 | 480 | 350 | 1 | 580 | 420 |

| Embodiment | Holding time (h) | Temperature of smelting chamber generating arsenic vapor (° C.) | Holding time (h) | Temperature of crystallization chamber for arsenic (° C.) | Holding time (h) | Arsenic purity (As %) | Dearsenization rate (%) |
|---|---|---|---|---|---|---|---|
| 1 | 2 | 600 | 7 | 270 | 7 | 80 | 50 |
| 2 | 2 | 630 | 7 | 300 | 7 | 82 | 55 |
| 3 | 1.5 | 650 | 6 | 300 | 6 | 85 | 60 |
| 4 | 1.5 | 670 | 6 | 320 | 6 | 97 | 70 |
| 5 | 2 | 680 | 6 | 300 | 6 | 86 | 80 |
| 6 | 1 | 700 | 5 | 350 | 5 | 99 | 90 |
| 7 | 2.5 | 730 | 4.5 | 320 | 4.5 | 99 | 94 |
| 8 | 1 | 730 | 5 | 350 | 5 | 99 | 97 |
| 9 | 1 | 750 | 3 | 320 | 3 | 99 | 98 |
| 10 | 1 | 760 | 3 | 340 | 3 | 99 | 98 |
| 11 | 1.8 | 750 | 3.5 | 350 | 3.5 | 99 | 98 |

The smelting chamber wall in the system of vacuum and pollution-free arsenic extraction provided in this invention is formed by corrosion resistant and heat conducting material, solving the problem of corrosion and low furnace life of existing horizontal type rotary vacuum furnace; since this vacuum smelting device is fixed through support, avoiding the fatal weakness of seriously polluting product due to large quantity of dust generated by material in furnace rotation, and the temperature is easily measured; a vapor drainage pipe 1 connected with the exhaust fan under the collecting and

The invention claimed is:

1. A system of vacuum and pollution-free arsenic extraction, comprising:

a smelting device;

a constant temperature crystallization device, fixed on the smelting device through a demountable device, wherein an interior smelting chamber of the smelting device is connected to a crystallization chamber of the constant temperature crystallization device so that arsenic vapor generated from ore concentrate in the smelting device can crystalize in the crystallization chamber and produce arsenic;

an automatic deslagging device, connected to a bottom of the smelting device so as to conduct deslagging, wherein the smelting device, the constant temperature crystallization device, and the automatic deslagging device each have a vacuum sealing in between;

a dust collection device, connected to the constant temperature crystallization device through a dust collection inlet pipe;

a vacuum measuring device and a vacuum extraction device, the vacuum extraction device being connected to the dust collection device through a pipe equipped with the vacuum measuring device to measure a system vacuum degree, so that arsenic sulfides volatilized from the ore concentrate in the smelting device are drawn into the dust collection device through the crystallization device by the vacuum extraction device;

induction heating equipment, having an inductor arranged on the smelting device, so as to heat the smelting device and the crystallization device to predetermined temperatures; and an automatic temperature control device, having thermal couples respectively mounted on the smelting device and on the constant temperature crystallization device, so as to control the temperatures of both devices.

2. A system of vacuum and pollution-free arsenic extraction as in claim 1, wherein the smelting device comprises:

a crucible formed by a detachable bottom, a cover, and a wall;

a vacuum furnace shell assembled outside the crucible; and a hollow collecting and exhaust pipe vertically mounted at a center of the crucible bottom, wherein an interior wall of the crucible and an exterior wall of the collecting and exhaust pipe form the smelting chamber, which connects to the crystallization chamber through a top of the collecting and exhaust pipe, a plurality of downward slant holes are distributed on a wall of the collecting and exhaust pipe, and a vapor drainage pipe is also installed under the collecting and exhaust pipe, which crosses the crucible bottom and connects with an exhaust fan.

3. A system of vacuum and pollution-free arsenic extraction as in claim 2, wherein a centerline of each slant hole of the collecting and exhaust pipe and a centerline of the collecting and exhaust pipe are in the same plane and form a 20-40 degree bevel with a lower end face of the collecting and exhaust pipe.

4. A system of vacuum and pollution-free arsenic extraction as in claim 2, wherein the crucible is made of corrosion proof and heat conducting material.

5. A system of vacuum and pollution-free arsenic extraction as in claim 4, wherein the crucible is made of graphite.

6. A system of vacuum and pollution-free arsenic extraction as in claim 2, wherein the inductor of the induction heating equipment is an intermediate frequency inductor, and the intermediate frequency inductor is in an integral cast in the insulating materials and is assembled in the vacuum furnace shell outside the crucible, the induction heating equipment also including intermediate frequency power, a capacitor for an electric induction heating system, and an intermediate frequency isolating transformer, the intermediate frequency isolating transformer being connected between an electric input end of the intermediate frequency inductor and the intermediate frequency power.

7. A system of vacuum and pollution-free arsenic extraction as in claim 2, wherein the inductor of the induction heating equipment is an intermediate frequency inductor and the inductor is assembled outside the vacuum furnace shell, the induction heating equipment also including intermediate frequency power and a capacitor for an electric induction heating system.

8. A system of vacuum and pollution-free arsenic extraction as in claim 7, wherein the vacuum furnace shell is made of a high temperature resistant, insulating, non-magnetoconductive, non-conducting, and non-leakage material.

9. A system of vacuum and pollution-free arsenic extraction as in claim 8, wherein the vacuum furnace shell is made of ceramic or 4-fluorothene plastic wire mesh.

10. A system of vacuum and pollution-free arsenic extraction as in claim 7, wherein insulating material is used to block a gap between the crucible wall and the vacuum furnace shell.

11. A system of vacuum and pollution-free arsenic extraction as in claim 1, wherein the constant temperature crystallization device comprises:

a bottomless shell;

an inner shell;

a plurality of multi-hole crystallization plates installed on one support; and a center heating pipe installed on the bottomless shell and extending at a vertical direction in a center of the shell, wherein a space in the inner shell forms the crystallization chamber, and the inner shell and a support of the multi-hole crystallization plate are fixed together with the bottomless shell through a dismountable device.

12. A system of vacuum and pollution-free arsenic extraction as in claim 11, wherein a small annular slit exists between the bottomless shell and the inner shell of the constant temperature crystallization device, and a bottom of the annular slit is plugged with refractory materials.

13. A system of vacuum and pollution-free arsenic extraction as in claim 1, wherein the automatic temperature control device comprises:

a thermal couple inserted on a crystallization chamber shell for measuring temperature in the crystallization chamber;

a thermal couple inserted at a furnace bottom for measuring the temperature of the smelting chamber; and a temperature controller connected to the thermal couples and the induction heating equipment through a compensation cord for respectively controlling the temperature in the furnace and the crystallization chamber.

14. A system of vacuum and pollution-free arsenic extraction as in claim 1, wherein the smelting device is installed above ground through a support, the smelting device further comprises a furnace bottom fixed to a crucible bottom, and the automatic deslagging device comprises a hopper, a slag car, and a hydraulic lift installed on the hopper, in which a furnace bottom is connected to a vacuum furnace shell through a top support of a hydraulic lift, between which vacuum sealing strips are used for vacuum sealing, and, upon lowering, the hydraulic lift can separate the furnace bottom and the crucible bottom from a crucible wall.

15. A system of vacuum and pollution-free arsenic extraction as in claim 14, wherein a layer of heat insulation material is arranged between the crucible bottom and the furnace bottom.

* * * * *